US005809895A

United States Patent [19]

Sandsted et al.

[11] Patent Number: 5,809,895

[45] **Date of Patent: *Sep. 22, 1998**

[54] SPLIT TOOL MECHANICAL VIBRATOR

[75] Inventors: Craig A. Sandsted; Marion D. Smith, both of Irmo, S.C.

[73] Assignee: Harsco Technologies Corporation, Fairmount, Minn.

[ * ] Notice: The term of this patent shall not extend beyond the expiration date of Pat. No. 5,584,248.

[21] Appl. No.: 893,359

[22] Filed: Jul. 16, 1997

Related U.S. Application Data

[63] Continuation of Ser. No. 758,023, Nov. 27, 1996, Pat. No. 5,730,059, which is a continuation-in-part of Ser. No. 408, 279, Mar. 22, 1995, Pat. No. 5,584,248.

[51] Int. Cl.[6] ..... E01B 27/16

[52] U.S. Cl. ..... 104/10; 104/12

[58] Field of Search ..... 104/10, 12, 14

[56] References Cited

U.S. PATENT DOCUMENTS

| | | | |
|---|---|---|---|
| 2,726,871 | 12/1955 | Schnellmann | 104/10 |
| 3,669,025 | 6/1972 | Plasser et al. | 104/12 |
| 3,677,187 | 7/1972 | Stewart | 104/10 |
| 3,901,159 | 8/1975 | Von Beckmann | 104/10 |
| 3,951,069 | 4/1976 | Dunlop | 440/57 |
| 3,998,165 | 12/1976 | Jaeggi | 104/12 |
| 4,332,200 | 6/1982 | Ganz | 104/12 |
| 4,501,200 | 2/1985 | Delucia | 104/10 |
| 4,576,095 | 3/1986 | Theurer | 104/12 |
| 4,744,303 | 5/1988 | Pasquini | 104/12 |
| 4,905,604 | 3/1990 | Theurer | 104/7.2 |
| 4,922,828 | 5/1990 | Theurer et al. | 104/10 |
| 5,146,677 | 9/1992 | Holman et al. | 29/243.5 |
| 5,269,225 | 12/1993 | Bosshart et al. | 104/2 |
| 5,584,248 | 12/1996 | Sansted et al. | 104/12 |

*Primary Examiner*—S. Joseph Morano
*Attorney, Agent, or Firm*—Eckert Seamans Cherin & Mellott

[57] ABSTRACT

A tamping assembly uses a split tool mechanical vibrator having corresponding front and back vibrator units powered by a single motor. A tamping tool provides easy connection to a tamping tool holder in such a way that two tamping tools may be mounted to one tool holder using a single bolt and wherein the tool holder has a channel in which a projection of the tamping tool is secured by a taper lock.

4 Claims, 7 Drawing Sheets

SPLIT TOOL MECHANICAL VIBRATOR

CROSS-REFERENCE TO RELATED APPLICATION

This is a continuation of U.S. application Ser. No. 08/758,023, filed on Nov. 27, 1996, now U.S. Pat. No 5,730,059, which is a continuation-in-part of U.S. application Ser. No. 08/408,279, filed Mar. 22, 1995 now U.S. Pat. No. 5,584,248, issued Dec. 17, 1996. That application, hereby incorporated by reference, relates to a vibrator apparatus and associated tamping tool holder and tamping tools.

BACKGROUND OF THE INVENTION

The present invention relates to an apparatus for maintenance of railroad beds. Specifically, it relates to a tamping apparatus and related tamping tool. Even more specifically, it relates to a tamping tool connection arrangement for connecting a tamping tool to a tool holder.

In the maintenance of road beds of railroads, the ballast must be periodically stabilized. Specifically, the rocks which make up the ballast are vibrated to get them into a compact stable state. Additionally, ballast should be pushed under the cross ties of the road bed in order to insure a stable support for the cross ties.

Various tamping machines have been used. Generally, such machines are rail vehicles which travel to a part of the road bed where tamping is required. Tamping tools are then lowered and vibrate into the ballast until in position where the tamping tools are moved to squeeze ballast under a cross tie. Specifically, tamping tools are disposed with paddles on their lower ends, the paddles being on opposite sides of a tie and below the level of the tie. The paddles are then pushed together to compress ballast under the tie, this being known as the squeeze in or squeeze position.

Prior U.S. Pat. No. 4,501,200 of Anthony Delucia, one of the inventors herein, describes a TAMPING TOOL RETAINER having an advantageous manner of connecting a tamping tool to a tool holder.

Standard tamping vibrator units have a width which makes it difficult or impossible to use them in tamping ballast at some locations around rail switches.

For switches, one could use two separate vibrators for opposite sides of a tie, but this might require two separate hydraulic or other motors to drive the corresponding front and back tamping tool holders associated with the respective front and back vibrator units. A two motor arrangement introduces additional costs and requires extra space for the second motor. Further, a two motor arrangement makes it difficult or impossible to coordinate the vibration of one unit with the vibration of the other unit.

Vibrator units often have required relatively complex arrangements in order to provide both the vibration supplied to the tamping tool in order to ease its insertion to the appropriate depth in the ballast and to provide the squeeze in movement.

Many vibrator units have tamping tool holders wherein removal and insertion of a tamping tool may require access to bolts, nuts, or other fasteners which are in difficult to access locations. In other words, removal or insertion of an old or replacement tamping tool into the holder may be difficult. In corresponding fashion, many tamping tool designs require bolting using multiple bolts and/or with bolts in a difficult to access location where clearance for use of a wrench or other tool is quite limited and/or visual observation is difficult.

OBJECTS AND SUMMARY OF THE INVENTION

Accordingly, it is a primary object of the present invention to provide a new and improved tamping apparatus.

A more specific object of the present invention is to provide a tamping assembly with an improved interface between a tamping tool and a tool holder.

A still further object of the present invention is to provide a new and improved tamping tool.

A still further object of the present invention is to provide a tamping assembly which avoids or minimizes the disadvantages noted above.

The above and other features of the present invention, which will be more readily understood when the following detailed description is considered in conjunction with the accompanying drawings, are realized by a railroad ballast tamping apparatus including a first tamping assembly having:

a vibration inducing shaft rotatable about a first axis;

a first tamping tool holder having a lower end accommodating a tamping tool thereon, the first tamping tool holder defining a longitudinal axis and the lower end having at least a longitudinally extending first channel therein, the first channel having a floor surface therein, the first tamping tool holder being operably connected to the first front vibration inducing shaft such that rotation of the first front vibration inducing shaft about the first front axis causes vibration of any tamping tool connected to the first tamping tool holder; and a first tamping tool having a tamping paddle at a bottom thereof and having a tool holder interface at a top thereof, the tool holder interface having a longitudinally extending projection with a main projection surface which faces the floor surface of the first channel, and wherein the first tamping tool is secured to the first tamping tool holder; and wherein the projection of the first tamping tool is secured within the first channel of the lower end of the tamping tool holder.

The protection of the first tamping tool includes projection side walls and the first channel has channel side walls and wherein the projection side walls and the channel side walls cooperate along a longitudinally extending contact zone in a locking taper connection. The channel side walls extend parallel to the longitudinal axis. The projection side walls extend parallel to the longitudinal axis. The channel side walls are at an angle of from one to ten degrees relative to a normal to the channel floor surface. The projection side walls are at an angle of from one to ten degrees relative to a normal to the projection main surface.

The first tamping tool holder further has a longitudinally extending second channel therein, the second channel having a floor surface therein, and further including: a first tamping tool having a tamping paddle at a bottom thereof and having a tool holder interface at a top thereof, the tool holder interface having a longitudinally extending projection with a main projection surface which faces the floor surface of the first channel, and wherein the first tamping tool is secured to the first tamping tool holder; and wherein the projection of the first tamping tool is secured within the first channel of the lower end of the tool holder.

A bolt secures the first tamping tool in the first channel and the second tamping tool in the second channel, the bolt being the only bolt used for the first and second tamping tools in corresponding channels.

The invention may alternately be described as a railroad ballast tamping apparatus including a first tamping assembly having:

a vibration inducing shaft rotatable about a first axis;

a first tamping tool holder having a lower end accommodating a tamping tool thereon, the first tamping tool holder defining a longitudinal axis, the first tamping tool holder being operably connected to the first front vibration inducing shaft such that rotation of the first front vibration inducing shaft about the first front axis causes vibration of any tamping tool connected to the first tamping tool holder; and a first tamping tool having a tamping paddle at a bottom thereof and having a tool holder interface at a top thereof, and wherein the first tamping tool is secured to the first tamping tool holder; and wherein the first tamping tool and the lower end of the first tamping tool holder fit together with a projection on one secured within a channel on the other, the channel having a floor surface and channel side walls, the projection being a longitudinally extending projection with a main projection surface which faces the floor surface of the channel and projection side walls, and wherein the channel side walls and projection side walls extend parallel to the longitudinal axis. The projection side walls and the channel side walls cooperate along a longitudinally extending contact zone in a locking taper connection. The channel has an upper stop surface and the projection has a top surface abutting the upper stop surface. The upper stop surface and the top surface are substantially perpendicular (i.e., within ten degrees) to the longitudinal axis.

The invention may alternately be described as a railroad ballast tamping apparatus including a tamping tool extending in a longitudinal axis and having a tamping paddle at a bottom thereof and having a tool holder interface at a top thereof, the tool holder interface having a longitudinally extending projection with a main projection surface operable to seat opposite a floor surface of a channel of a tamping tool holder, and wherein the projection of the tamping tool includes projection side walls and wherein the wherein the projection side walls are operable to cooperate with channel side walls along a longitudinally extending contact zone in a locking taper connection. The tamping tool further includes only one bolt hole extending therethrough. The first tamping tool is part of a tamping assembly, the tamping assembly further including a tamping tool holder having a lower end to which the first tamping tool is secured. The projection side walls are at an angle of from one to ten degrees relative to a normal to the projection main surface. More preferably, the projection side walls are at an angle of from five to six degrees relative to a normal to the projection main surface. The channel side walls extend parallel to the longitudinal axis.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
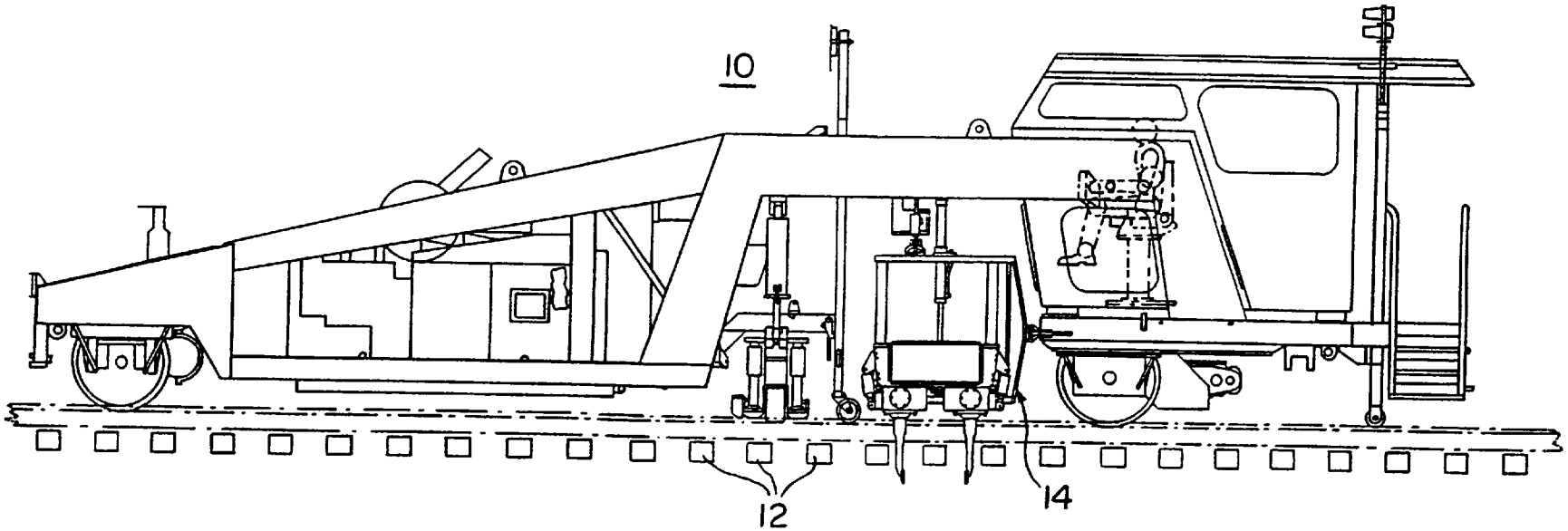
FIG. 1 is a side view of a rail bound tamping vehicle according to the present invention.

With reference now to FIG. 1, the tamping vehicle 10 of the present invention is a rail bound vehicle used for tamping of ballast (not shown) below the cross ties 12. A tamping assembly 14 is movably mounted to the vehicle 10. Since the vehicle is relatively standard with its 4 flanged wheels, power plant, and other components except for the tamping assembly 14, the discussion which follows will emphasize the tamping assembly 14.

Figure 2:
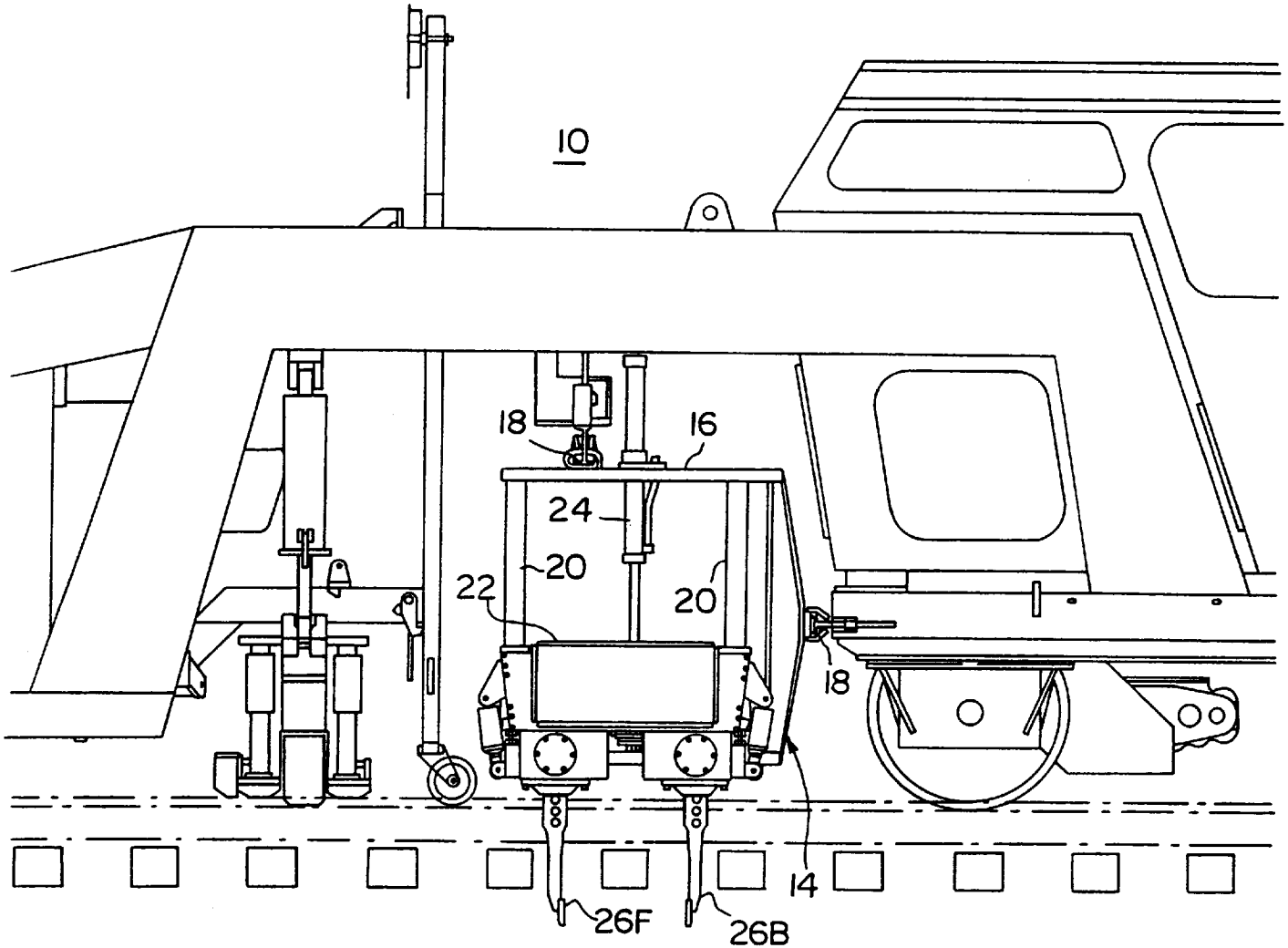
FIG. 2 is a larger side view of parts of the vehicle of FIG. 1.
Figure 3:
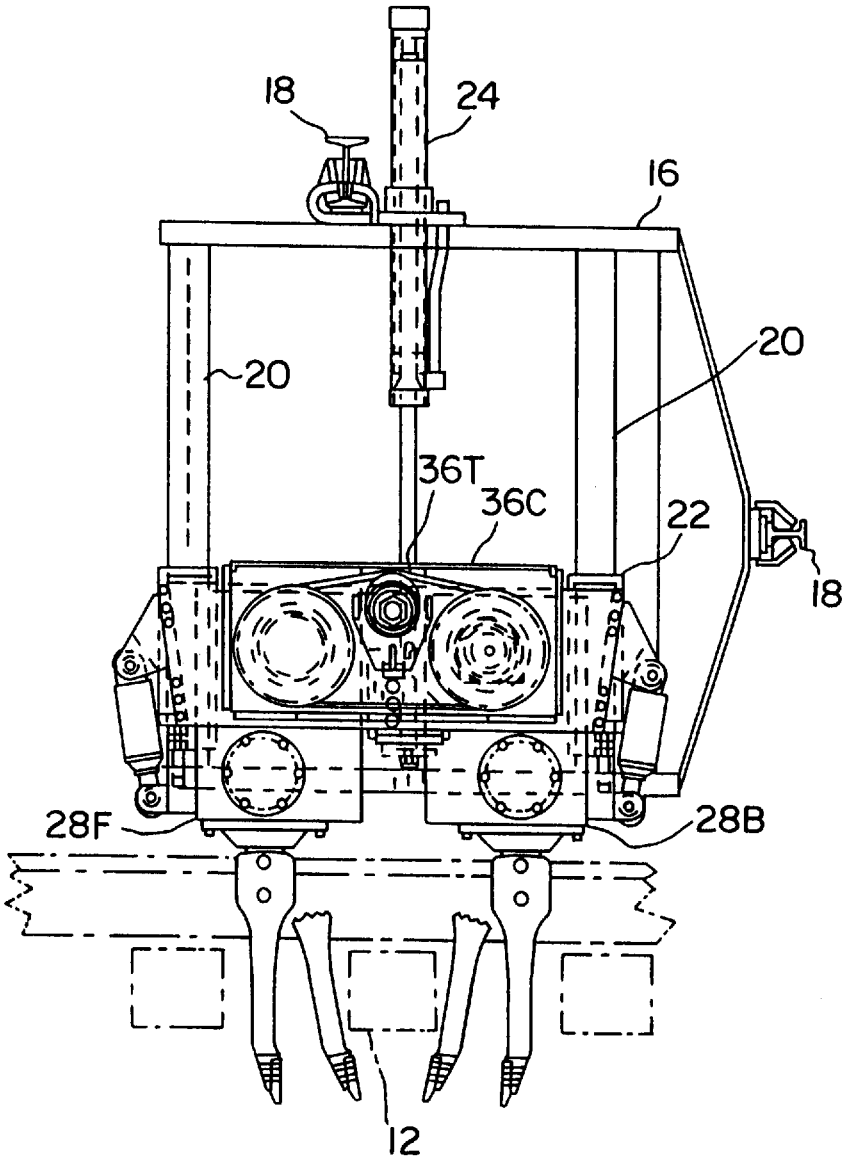
FIG. 3 is a side view of a split tool mechanical vibrator of the present invention with parts of a belt cover broken away.

The tamping assembly 14 is shown in more detail in FIGS. 2 and 3. A support frame 16 is slidably mounted to transverse beams 18, which are part of the vehicle main frame. The support frame may slide left and right (normal to the plane of view of FIGS. 2 and 3) relative to the vehicle 10 by using known techniques which need not be described herein. Support frame 16 has guide rods 20 on which a carrier frame 22 is movable up and down under control of lift hydraulic cylinder or actuator 24. The tamping assembly has front and back tamping tools 26F and 26S respectively, which may be inserted and removed from ballast (not shown) by operation of cylinder 24 moving carrier frame 22 relative to the support frame 16.

Figure 5A:
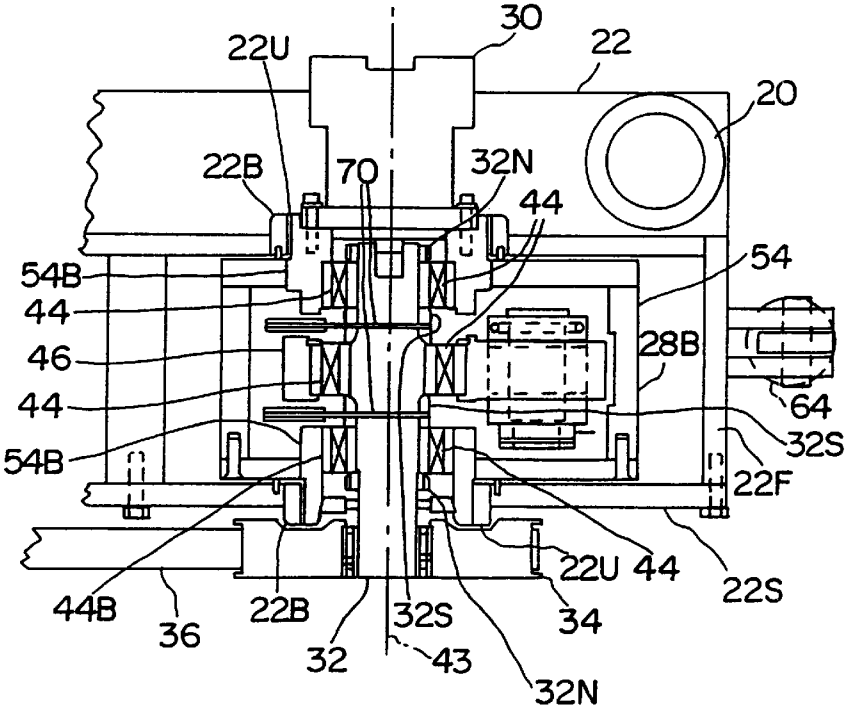
FIG. 5A is an enlarged cross section top view of a portion of the FIG. 5 structure.
Figure 4:
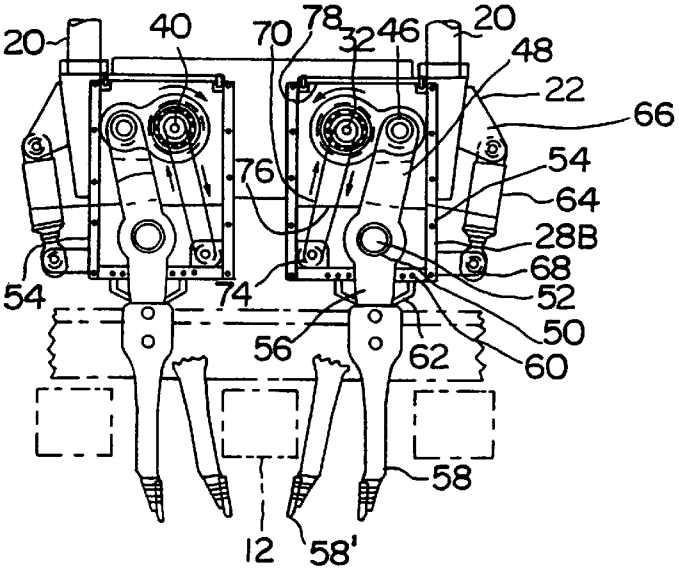
FIG. 4 is a cross section side view of the vibrator with various parts including a housing side removed for ease of illustration.
Figure 5:
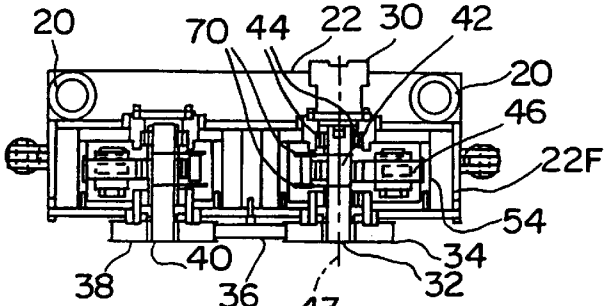
FIG. 5 is a cross section top view of the vibrator.

Referring now to FIGS. 3–5, a forward vibrator 28F and back vibrator 28B which are constructed identical in a symmetric fashion as mirror images except as will be specifically noted below. Basically, the back vibrator 28B serves as a driver for the front vibrator 28F. Specifically, hydraulic motor 30 disposed within a hole (not separately shown) in the frame 22 is mounted to vibrator 28B and rotates a back vibration inducing shaft 32 (pivotably mounted to the carrier frame 22) having synchronous sprocket 34 mounted on an end therein. Sprocket 34 is connected by synchronous belt 36 within belt cover 36C to a front sprocket 38, which in turn rotates a front vibration inducing shaft 40. The belt 36 is kept tight by tensioner 36T. The front vibration inducing shaft 40 is pivotably mounted to the vibrator 28F. Since the various components moved by rotation of the front and back shafts 40 and 32 are identical in construction and operation for the front vibrator 28F and back vibrator 28B, an explanation of the construction and operation of components of back vibrator 28B will be sufficient.

Referring to FIGS. 4, 5, and 5A, shaft 32 has an eccentric portion 42 which rotates with shaft 32 about its central axis 43. The eccentric portion 42 may be integral with shaft 32 or be a separate eccentric member rotatable therewith. Ball bearings 44 are around eccentric 42 and the left side (FIG. 4) of a connector member 46, which is shaped like a sideways FIG. 8 with a smaller right side. Rotation of the eccentric 42 moves the connector 46 right and left in FIG. 4. The right side of connector 46 is pivotably connected to the upper end of a tamping tool holder 48 such that the upper end is moved right and left in FIG. 4. The tool holder 48 has a middle portion with hole 50 therein and a tool holder mounting shaft 52 extends through the hole 50 to pivotably mount tool holder 48 to a back vibrator housing 54. (The side of the box-like housing 54 is removed from FIG. 4 and the top of housing 54 is removed from FIGS. 5 and 5A, all to more readily show the parts inside the housing 54.) Accordingly, the right and left movement of the upper end of tool holder 48 will cause the holder 48 to pivot back and forth about a central axis of the mounting shaft 52. This in turn causes a tamping tool accommodating lower end 56 to vibrate a tamping tool 58 mounted thereon left and right in FIG. 4 (forward and backward relative to the vehicle and the rails). The lower tip of tamping tool 58 will vibrate with about a ⅜ inch amplitude relative to the central axis of shaft 52. Thus, the central axis of shaft 52 may be considered as a vibration axis about which tamping tool 58 vibrates. This is, as shown, separate and offset from the center axis 43 (FIG. 5A) which serves as an axis for the squeeze in pivoting as discussed below. Slight front and back movements (left and right in FIG. 4) of lower end 56 of tool holder 48 are accommodated by a rubber seal 60 which is clamped to an opening in the floor of housing 54 and clamped to a portion of the lower end 56. The rubber seal 60 is protected from flying debris by a steel boot 62 having sufficient clearance to avoid interfering with vibration of the holder 48. The vibration of the tamping tool 58 eases its insertion into the ballast when lowered by cylinder 24 (refer back momentarily to FIG. 3).

After insertion into the ballast, tamping tool 58 is moved from its normal position (58 in right of FIG. 4) to its squeeze in position at 58' (forward of 58, left relative to FIG. 4). This movement is accomplished by extending a squeeze actuator 64 (specifically a hydraulic cylinder) having its upper end pivotably secured to a flange 66 fixed to carrier 22 and its lower end pivotably secured to a flange 68 fixed to rear vibrator housing 54. The extension causes the housing 54 and associated parts supported thereby including holder mount shaft 52 to pivot clockwise relative to carrier 22 in FIG. 4 about central axis 43 (FIG. 5) of vibration shaft 32. The advantageous feature of squeeze in pivoting about the same axis as used for the vibration inducing shaft helps keep the design relatively simple and compact. The movement of housing 54 and mount shaft 52 moves tamping tool 58 to its squeeze in position corresponding to 58'.

The details of parts within housing 54 and details of the squeeze in operation will be explained with reference to FIG. 5A. Mounted as part of frame 22 are first and second plates 22F and 22S respectively. Carrier bosses 22B are fixed to carrier frame 22 and have carrier bushings 22U therein. The bearings 44 (except bearing 44 associated with connector 46) are within vibrator housing bosses 54B which may rotate with housing 54 and associated components about axis 43 upon squeeze in operation. Bosses 54B are in turn within the carrier or frame bushings 22U, thus allowing the vibrator assembly 28B including motor 30, housing 54 and components therein and supported thereto to rotate relative to frame 22 about axis 43 upon extension or retraction of cylinder 64.

FIGS. 4, 5 and 5A will be used to explain a lubrication feature of the present invention. Specifically, the vibration inducing shaft 32 has two bearing spacers 32S fixed to shaft 32 and having circumferential grooves therein about which two corresponding lubricant carrying belts 70 (FIGS. 5 and 5A show both, only one visible in FIG. 4) extend. Although two such belts are shown, an alternative would simply use a single belt. The belts 70 extend down into a lower lubricant sump portion 72 of oil or other lubricant where each extends around a corresponding idler wheel 74 (one visible in FIG. 4 only). The lubricant belts are driven by the clockwise rotation of the shaft 32 to carry oil or other lubricant from below the lubricant level 76 and throw the oil on ceiling 78 such that it may drip onto and lubricate appropriate parts of connector 46, shaft 32, and related parts, thereby providing lubrication and cooling.

The belts 70 may have a round cross section or may have a twisted arrangement with a quick connect link, belts of both types being made by a company named Dura-Belt and sold under the DURA-BELT trademark.

It should again be noted that the front vibrator 28F is constructed such that it may vibrate and squeeze as discussed for back vibrator 28B, there being duplicate front components corresponding to all of the back components discussed except that the single hydraulic motor 30 vibrates the front by way of belt 36 and vibrates the back more directly. Advantageously, the vibrating sequence of the front vibrator 28F is 180 degrees out of phase with the back vibrator 28B to effectively cancel out any vibration force that would otherwise be transmitted to the main frame of the vehicle. The 180 degree phase difference is maintained by timing the front vibrator relative to the back vibrator by using the synchronous cog type belt 36. When the front vibrator is moving its tamping tool forward, the back vibrator will be moving its tamping tool backward. When the back vibrator is moving its tamping tool forward, the front vibrator will be moving its tamping tool backward. The front and back squeeze cylinders (only back 64 is numbered) would usually be operated at the same time so that both tamping tools push in opposite directions on ballast under a particular cross tie. The phase difference would preferably be 180 degrees, but more generally might be 170 to 190 degrees out of phase and even more generally might be 160 to 200 degrees out of phase.

Figure 6:
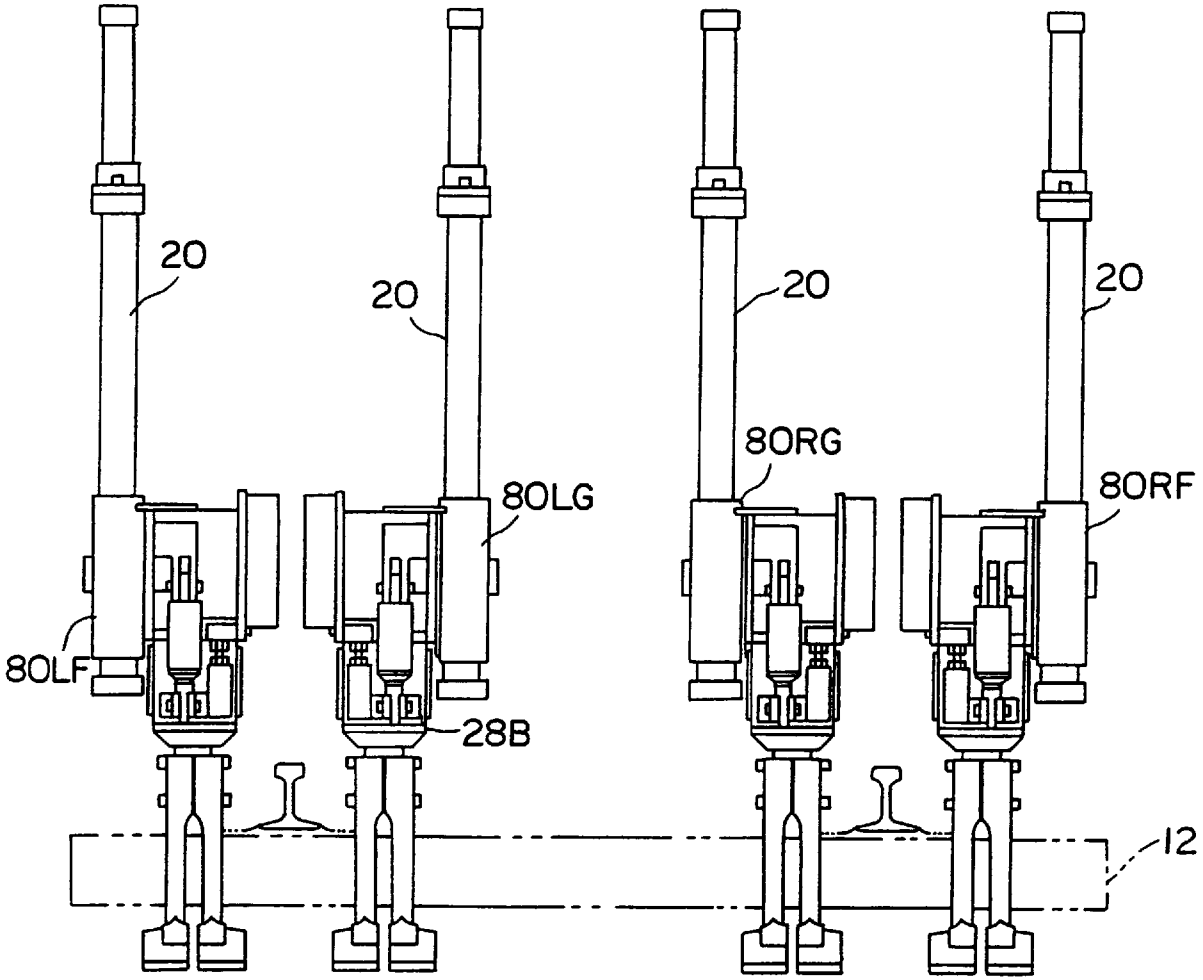
FIG. 6 is an end view showing four complete vibrator assemblies, each being one of the split tool mechanical vibrators.

With reference now to the back view of FIG. 6, there are four complete tamping assemblies 80LF, 80LG, 80RG, and 80RF corresponding to left field side, left gauge side, right gauge side, and right field side, each of them having a front and back vibrator such as 28F and 28B discussed below. They may have minor variations between them (not shown) such that the back vibrator of one may have a motor as discussed in connection with FIGS. 4, 5, and 5A, whereas the immediately adjacent assembly would have a motor on its front vibrator, thus facilitating the nesting of the structures. Each of the tamping assemblies is independently movable up and down on its own pair of guide rods 20 (only one for each assembly is visible in FIG. 6) using a corresponding support frame and cylinder 24. Each of the support frames would be movable transversely (left and right in FIG. 6) relative to the vehicle using known techniques not illustrated. Therefore, the field side assemblies may be movable to with the rails and/or the gauge side assemblies are movable out from between the rails. The terms gauge and field are used simply to indicate which side (gauge or field) the assembly is closest to. By having assembly 80LF movable up and down independently of the assembly 80LG, one can do tamping operations around railroad switches or in other difficult to access locations. In contrast, usual prior designs have gauge and field side assemblies united such that lifting of the left gauge side assembly for example requires lifting of the left field side assembly as well. Of course, such prior assemblies were constructed with numerous other differences relative to the present invention.

Figure 7:
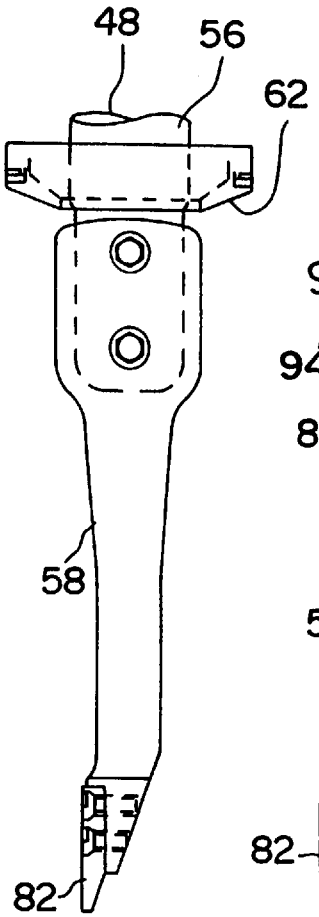
FIG. 7 is a side view of a tool holder portion and associated tamping tool.
Figure 8:
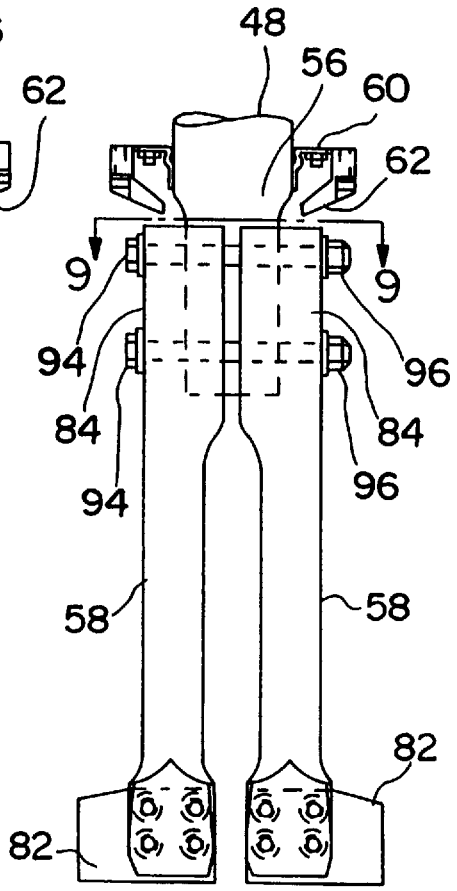
FIG. 8 is a front view of a tool holder portion and associated tamping tools.
Figure 9:
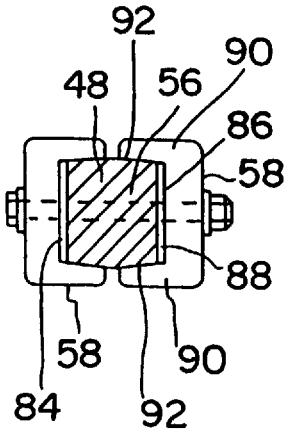
FIG. 9 is a cross section view taken along lines 9—9 of FIG. 8.

With reference now to FIGS. 7–9, the attachment of tamping tools 58 to the lower end 56 of tamping tool holder 48 will be described. As shown in FIG. 8, two tamping tools 58 are attached to the lower end 56 of a tool holder 48. The tamping tools 58 are identical, one being the mirror image of the other. Each tamping tool has a paddle 82 bolted, welded, molded integrally therewith, or otherwise attached to a lower end thereof and a tool holder interface 84 at a top end thereof.

The tool holder interface 84 has a generally vertical surface 86 (i.e., it is within 20 degrees of vertical when fixed to a tool holder 48 in normal, not squeeze in position) which faces the opposing outer surface 88 of the tamping tool holder 48. The interface 84 is a channel having its generally vertical surface 86 as the floor of the channel and having two opposite channel sidewalls 90. The channel sidewalls 90 taper out and away from the floor 88 for partially wrapping about the tamping tool holder 48. Lower end 56 of holder 48 has sides 92 which taper together towards surface 88. The right and left halves of lower end 56 are mirror images of each other. More preferably, the generally vertical surface is within 10 degrees of vertical when fixed to a tool holder 48 in normal, not squeeze in position. Even more preferably, the generally vertically surface is within 5 degrees of vertical when fixed to a tool holder 48 in normal, not squeeze in position.

Bolts 94 extend through holes in the two tamping tools 58 and corresponding through holes in lower end 48 and are secured by self-locking nuts 96. The complementary tapering of sidewalls 90 and sides 92 creates a taper lock when the bolts are tightened in place. Bolts 94 and nuts 96 are readily accessible for attachment and removal purposes.

Turning now to FIGS. 10–13, an alternate embodiment vibrator 128 is shown. The vibrator 128, which may have separate front and back sections (only one section shown) as shown for FIG. 4 has components numbered in the "100" series with the same last two digits as the corresponding component, if any, of the first embodiment. Thus, vibrator 128, tamping tool holder 148 and its lower end 156 and tamping tool 158 function in the same fashion as the corresponding components in the first embodiment except as noted below. (Components in the "200" series are not intended to reference similar components of the earlier design.)

The connections between tools 158 and holder lower end 156 is different than in the first design. In particular, the tools 158 have a projection 200 with a main projection surface 202 and projection side walls 204. As best shown in the FIG. 13 with only portions of the components illustrated, the projection 200 fits in a channel 206 having channel side walls 208 and a channel floor 210. The main projection surface 202 is slightly offset from the floor 210 when a bolt 212 and nut 214 have secured the tools 158 to the holder lower end 156. However, the projection side walls 204 and the channel side walls 208 are planar surfaces that create a low angle taper lock. Thus, although shown slightly offset in FIG. 13 for ease of illustration, surface 208 would tightly clamp to surface 204. Since the projection 200 is tightly clamped between two such channel surfaces 208, the surfaces 208, rather than the bolt 212, will absorb most of the side bearing load as the tool is used. Additionally, a planar stop surface 214 (FIG. 11) corresponding to the top of channel 206 bears upwardly pushing loads as transmitted by planar top surface 216 (FIG. 12) of the projection 200. Both surfaces 214 and 216 are preferably perpendicular and at least substantially perpendicular (i.e., within ten degrees) relative to a longitudinal axis 156A of tool 156. Thus, a single bolt 212 is sufficient to absorb the stresses since the various contact surfaces between the projection 200 and channel 206 take most of the load. Additionally, when the bolt 212 is removed, the clamping action continues and a hammer or other tool may be used to dislodge the tool 158 from tool holder lower end 156.

Figure 13:
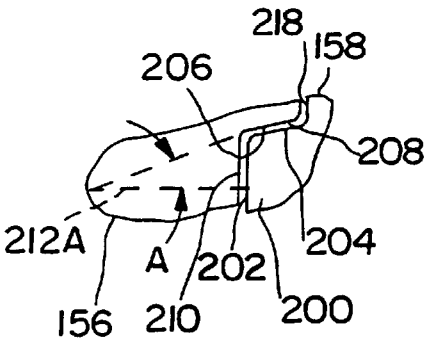
FIG. 13 is an enlarged view of portions of components within circle 13 of FIG. 12.
Figure 12:
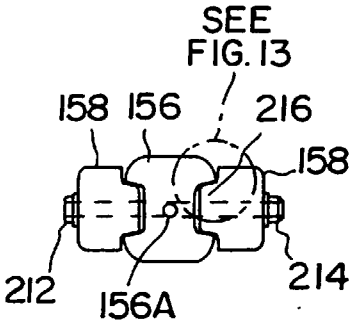
FIG. 12 is a cross-section taken along lines 12—12 of FIG. 11.
Figure 11:
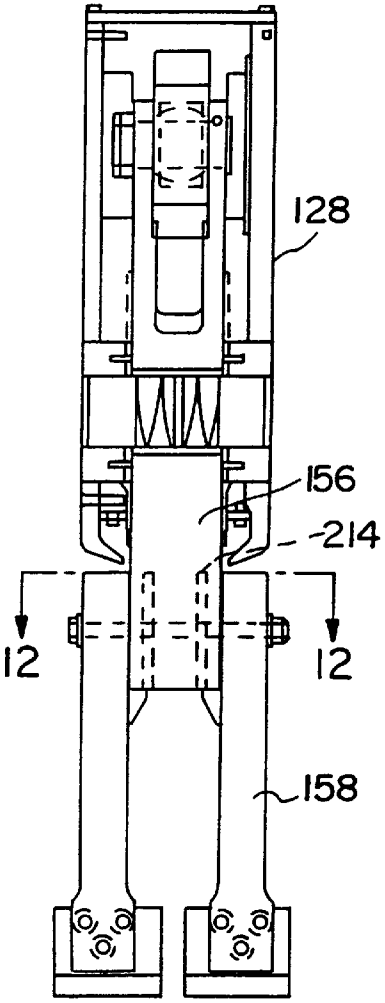
FIG. 11 is an end view showing the modified vibrator of FIG. 10.
Figure 10:
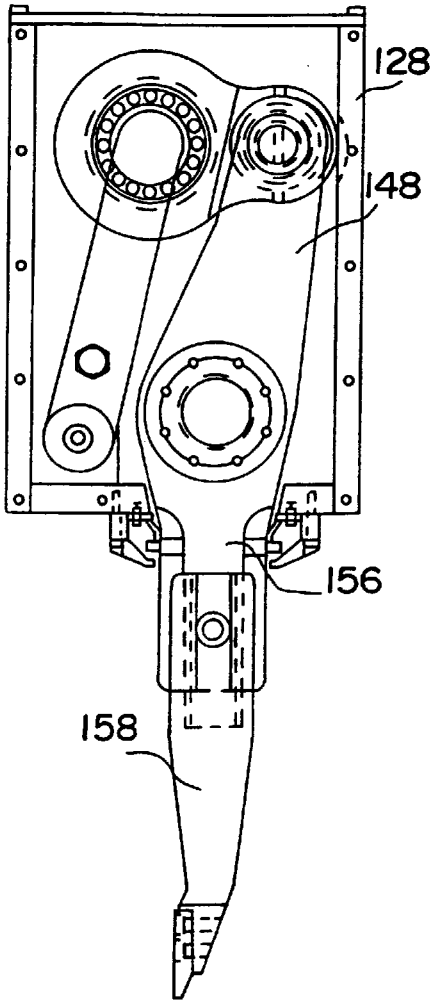
FIG. 10 is a cross section side view of half of a modified vibrator with various parts including a housing side removed for ease of illustration.

With continued reference to FIG. 13, the angle between the channel side walls 208 and the bolt axis 212A is an angle A. That same angle is the angle between the projection side walls 204 and the axis 212A. Since the axis 212A is parallel to and corresponds to a normal to the planar main projection surface 202 and a normal to the planar channel floor 210, the angle A defines the angle of the projection side walls 204 relative to the normal to the main projection surface 202 and defines the angle of the channel side walls 208 relative to the normal to the floor 210. That angle A is from one to ten degrees. More specifically or preferably, it is from five to six degrees. It provides the taper lock along a longitudinally extending contact zone between projection side walls 202 and channel side walls 208.

As used herein, the longitudinal axis extends along the length of tool 158 and along the parallel length of the lower end 156 of holder 148. That longitudinal axis is normal to the plane of view of FIG. 12 and corresponds to point 156A in that FIG. It should be noted that the planar surfaces of 202, 204, 208, and 210 all extend parallel to the longitudinal axis 156A. Specifically, although surfaces 202 and 208 are tapered in towards floor 210, they are not tapered relative to the longitudinal axis 156A.

The embodiment of FIGS. 10–13 is similar to the first embodiment except that the interface between the tamping tools and the tool holders are different. Briefly comparing the FIG. 9 embodiment with that of FIGS. 12 and 13, the FIG. 9 arrangement has a portion of the holder serving as a projection projecting into a channel in the tamping tool, whereas the second embodiment has a projection 200 on the tool with a shoulder portion 218 (FIG. 13) only on each side and the channel in the tool holder. Additionally, the second embodiment includes the load transmitting or bearing surfaces 214 and 216 as discussed above.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A railroad ballast tamping apparatus comprising a first tamping assembly having:

a vibration inducing shaft rotatable about a first axis;

a first tamping tool holder having a lower end accommodating a tamping tool thereon, the first tamping tool holder defining a longitudinal axis, the first tamping tool holder being operably connected to the vibration inducing shaft such that rotation of the vibration inducing shaft about the first axis causes vibration of any tamping tool connected to the first tamping tool holder; and the tamping tool having a tamping paddle at a bottom thereof and having a tool holder interface at a top thereof, and wherein the tamping tool is secured to the first tamping tool holder; and wherein the tamping tool and the lower end of the first tamping tool holder fit together with a projection on one secured within a channel on the other, the channel having a floor surface and channel side walls, the projection being a longitudinally extending projection with a main projection surface which faces the floor surface of the channel and projection side walls, and wherein the channel side walls and projection side walls extend parallel to the longitudinal axis.

2. The railroad ballast tamping apparatus of claim 1 wherein the channel side walls are at an angle of from one to ten degrees relative to a normal to the channel floor surface.

3. The railroad ballast tamping apparatus of claim 2 wherein the projection side walls are at an angle of from one to ten degrees relative to a normal to the projection main surface.

4. The railroad ballast tamping apparatus of claim 3 wherein the projection side walls and the channel side walls cooperate along a longitudinally extending contact zone in a locking taper connection.

* * * * *